US005732439A

United States Patent [19]

Cipolla

[11] Patent Number: 5,732,439

[45] Date of Patent: Mar. 31, 1998

[54] DIRT DOOR LINKAGE SYSTEM

[75] Inventor: Mark E. Cipolla, Chardon, Ohio

[73] Assignee: Royal Appliance Mfg. Co., Cleveland, Ohio

[21] Appl. No.: 574,952

[22] Filed: Dec. 19, 1995

[51] Int. Cl.[6] ..... A47L 5/32

[52] U.S. Cl. ..... 15/334; 15/351

[58] Field of Search ..... 15/331, 334, 337, 15/333

[56] References Cited

U.S. PATENT DOCUMENTS

| | | | |
|---|---|---|---|
| 2,348,861 | 5/1944 | Smellie | 15/331 X |
| 2,375,331 | 5/1945 | Taylor | 15/332 X |
| 2,734,219 | 2/1956 | Kaufman . | |
| 3,588,945 | 6/1971 | Krier et al. . | |
| 3,879,797 | 4/1975 | Principe et al. . | |
| 4,023,234 | 5/1977 | Martinec et al. | 15/331 |
| 4,376,322 | 3/1983 | Lockhart et al. . | |
| 4,701,975 | 10/1987 | Hampton et al. . | |
| 4,951,346 | 8/1990 | Salmon | 15/331 X |
| 5,243,734 | 9/1993 | Maurer et al. . | |
| 5,247,720 | 9/1993 | Sovis et al. . | |
| 5,351,361 | 10/1994 | Buchtel . | |
| 5,477,586 | 12/1995 | Jacobs et al. | 15/332 |
| 5,483,726 | 1/1996 | Blase et al. | 15/331 X |
| 5,560,074 | 10/1996 | Graham et al. | 15/331 X |

FOREIGN PATENT DOCUMENTS 414601 8/1934 United Kingdom .

*Primary Examiner*—Chris K. Moore

[57] ABSTRACT

A suction cleaner includes a nozzle body having a suction inlet and a handle pivotally connected to the nozzle body. A suction creating device is located in one of the handle and the body. An air passageway leads from the suction inlet to the suction creating device. A valve member is located in the air passageway. The valve member includes a shaft pivotally mounted in the nozzle body and a valve element fixedly mounted on the shaft. The valve member is selectively pivoted in a first direction by a lever pivotally mounted on the nozzle body and actuated by a movement of the handle of the suction cleaner. A link member, having a first end secured to the lever and a second end secured to the shaft, connects the lever to the valve member. A biasing member, preferably mounted on the shaft, urges the valve member in a second direction.

21 Claims, 6 Drawing Sheets

DIRT DOOR LINKAGE SYSTEM

BACKGROUND OF THE INVENTION

The present invention relates to vacuum cleaners. More particularly, the instant invention relates to improvements in the nozzle structure of a convertible vacuum cleaner which can be utilized either for on-the-floor cleaning or for off-the-floor cleaning as desired.

Many vacuum cleaners heretofore developed and presently available are capable of both on-the-floor cleaning and above-the-floor cleaning. Such convertible vacuum cleaners usually employ a suction generating fan and some sort of valve for controlling the application of the suction developed by the fan either to a floor nozzle or to an auxiliary suction inlet located on the housing of the cleaner. One end of a flexible suction hose is generally attached to such a suction inlet. The opposite end of the hose is usually adapted to receive one of a variety of tools suited for above-the-floor cleaning, such as brushes, wands and the like.

While the suction controlling valves utilized in such convertible cleaners are generally capable of performing their intended function, they have not proven to be entirely satisfactory. More particularly, the known suction valves that are actuated by a pivoting motion of the handle of the vacuum cleaner have required that the valve structure be located adjacent the bottom portion of the handle. This location is necessary to allow the handle to act on the valve. Therefore, the valve has not necessarily been able to be located at the optimal position in the nozzle body of the vacuum cleaner. Sometimes the air path leading from the nozzle to the dirt chamber of the vacuum cleaner is so located that the suction controlling valve is distanced away from the bottom of the handle making it difficult for the rotation of the handle to control the actuation of the valve.

Accordingly, it has been considered desirable to develop a new and improved convertible vacuum cleaner which would overcome the foregoing difficulties and others while providing better and more advantageous overall results.

BRIEF SUMMARY OF THE INVENTION

In accordance with the present invention, a suction cleaner is provided.

More particularly in accordance with this aspect of the invention, a suction cleaner comprises a nozzle body including a suction inlet and a handle pivotally connected to the body. A suction creating means is located in one of the handle and the body and an air passageway leads from the suction inlet to the suction creating means. A valve member is located in the air passageway wherein the valve member comprises a shaft pivoted in the nozzle body and a valve element fixedly mounted on the shaft. A means for selectively pivoting the valve member in a first direction comprises a lever pivotally mounted on the nozzle body and a link member having a first end secured to the lever and a second end secured to the shaft. A means is provided for urging the valve member in a second direction. The means for urging comprises a biasing member mounted on one of the shaft and the nozzle body and contacting the valve member.

Preferably the lever comprises an L-shaped member having a first end to which an end of the link member is secured and a second end. Preferably the second end of the L-shaped member cooperates with the handle. The handle can, if desired, comprise a groove in which the second end of the L-shaped member is seated and a wall terminating the groove. A rotation of the handle to an upright position will rotate the lever as it contacts the wall terminating the groove in order to rotate the lever and cause the valve to close the air path.

Preferably the valve member further comprises a flange to which an end of the link member is secured. If desired, the means for selectively pivoting can further comprise a resilient spring connected to the link member. If desired, the link member can comprise a first section, a spring member and a second section wherein the spring member is of one piece with the first and second sections. The biasing member preferably comprises a spring.

One advantage of the present invention is the provision of a new and improved convertible vacuum cleaner.

Another advantage of the present invention is the provision of a convertible vacuum cleaner which is low in cost and easy to manufacture, but is sturdy and is capable of withstanding prolonged use.

Still another advantage of the present invention is the provision of a convertible vacuum cleaner which enables both on-the-floor cleaning operations, with the aid of a rotating brush, and above-the-floor cleaning operations. The vacuum cleaner can be easily switched from one operation to the other via a valve member.

Yet another advantage of the present invention is the provision of a convertible vacuum cleaner in which a rigid link element is used to connect a lever to a suction control valve member. This construction is advantageous from the standpoint that it is easy and inexpensive to manufacture. It is also advantageous from the standpoint that it allows the valve member to be distanced from the lever. The link element allows the valve member to be optimally located in the suction cleaner since the valve member can be spaced from the lever because the link element connects the two.

A further advantage of the present invention is the provision of a convertible vacuum cleaner which employs an overload means on a valve that closes a passageway leading from a floor nozzle to a suction creating means. The overload means enables a continued rotation of a portion of a valve assembly while a valve element thereof is prevented from continued rotation by a blockage in a passageway in which the valve element is pivotally mounted.

A still further advantage of the present invention is the provision of a vacuum cleaner that has a valve member which automatically closes an air passageway leading from a suction inlet of a floor nozzle to a suction creating means upon a pivoting movement of a vacuum cleaner handle to an upright position.

Still other benefits and advantages of the invention will become apparent to those skilled in the art upon a reading and understanding of the following detailed specification.

BRIEF DESCRIPTION OF THE DRAWINGS

The invention may take form in certain parts and arrangements of parts, preferred embodiments of which will be illustrated in the accompanying drawings which form a part hereof and wherein.

DETAILED DESCRIPTION OF THE PREFERRED EMBODIMENTS

Figure 1:
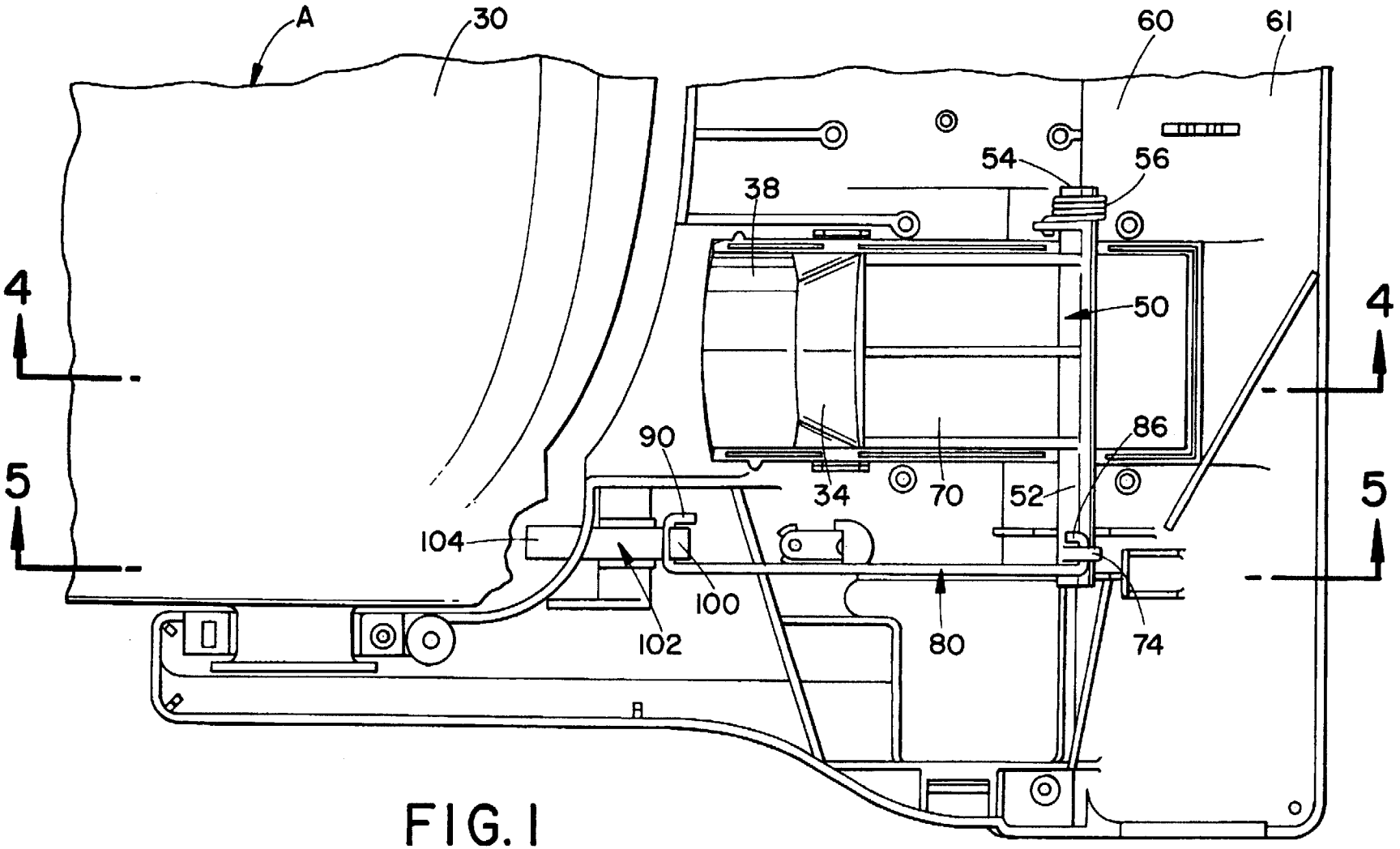
FIG. 1 is a top plan view of a right hand portion of a disassembled nozzle base, partially broken away, and an adjacent handle body of a vacuum cleaner, also partially broken away, according to the present invention.

Referring now to the drawings wherein the showings are for purposes of illustrating preferred embodiments of the invention only and not for purposes of limiting same, FIG. 1 shows the subject new vacuum cleaner A. While the valving structure illustrated is primarily designed for, and will hereinafter be described in connection with a specific type of hard shell upright convertible vacuum cleaner, it should be appreciated that several of the features disclosed herein can be adapted for use in many different types of vacuum cleaners.

Figure 5:
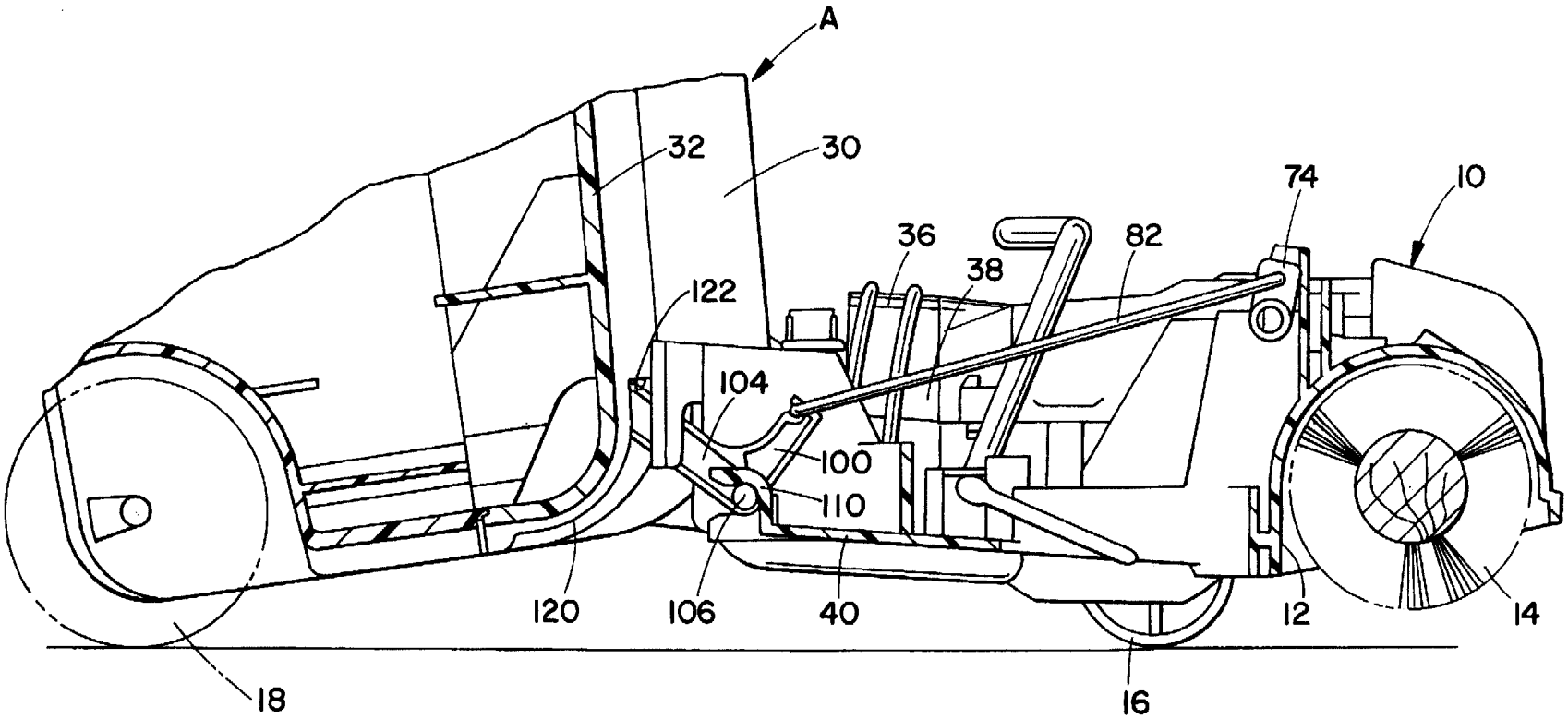
FIG. 5 is a side elevational view in cross-section of the vacuum cleaner of FIG. 1 along line 5—5.

With reference now to FIG. 5, the vacuum cleaner A includes a nozzle base 10 containing a suction inlet 12 which defines a brush chamber. Mounted therein is a rotatable brush 14. Supporting the nozzle base on a subjacent floor surface are a pair of first wheels 16 (only one of which is visible in FIG. 5) and second wheels 18 (only one of which is visible in FIG. 5).

Figure 4:
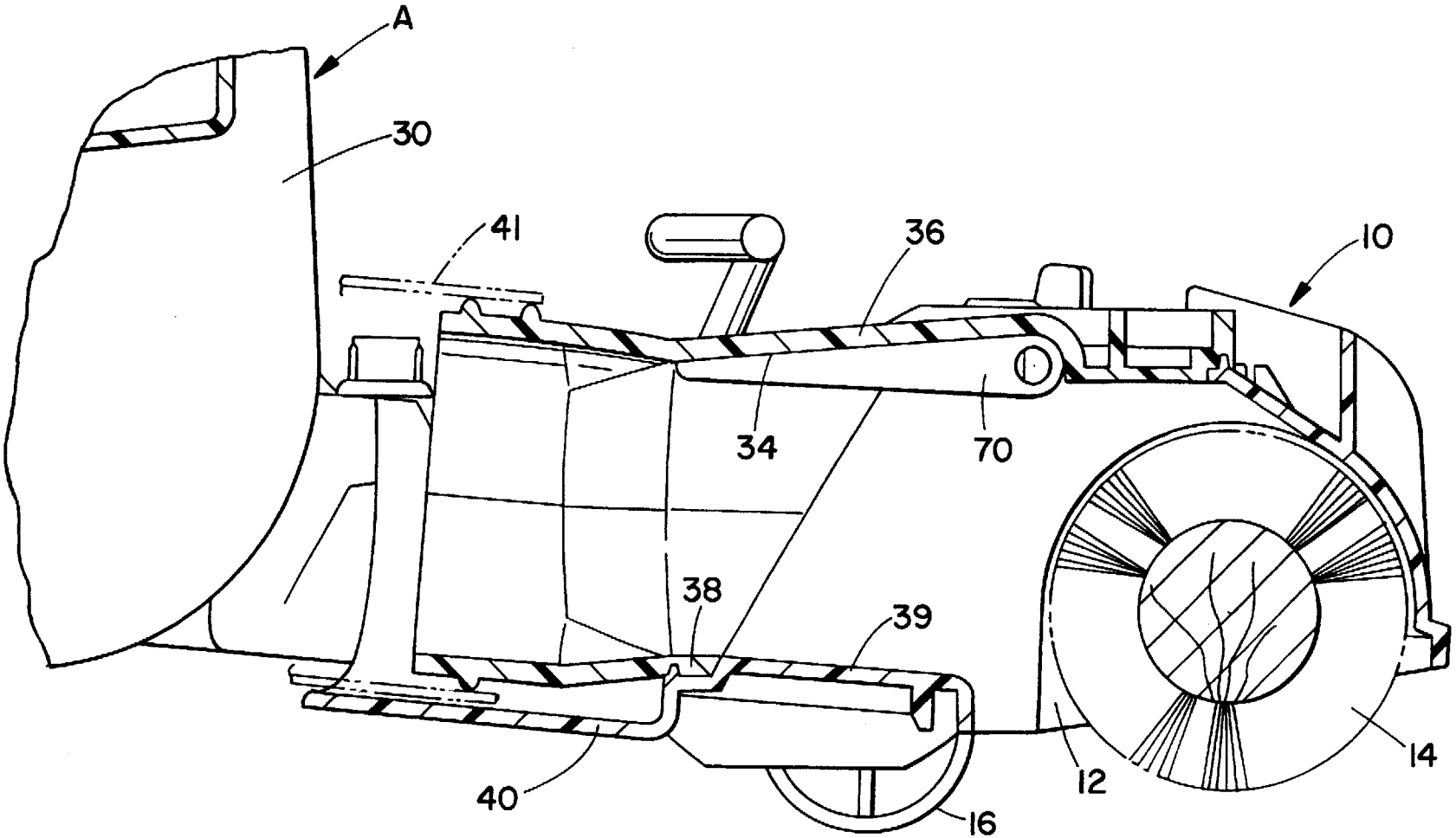
FIG. 4 is a side elevational view in cross-section of the vacuum cleaner of FIG. 1 along the line 4—4.
Figure 7:
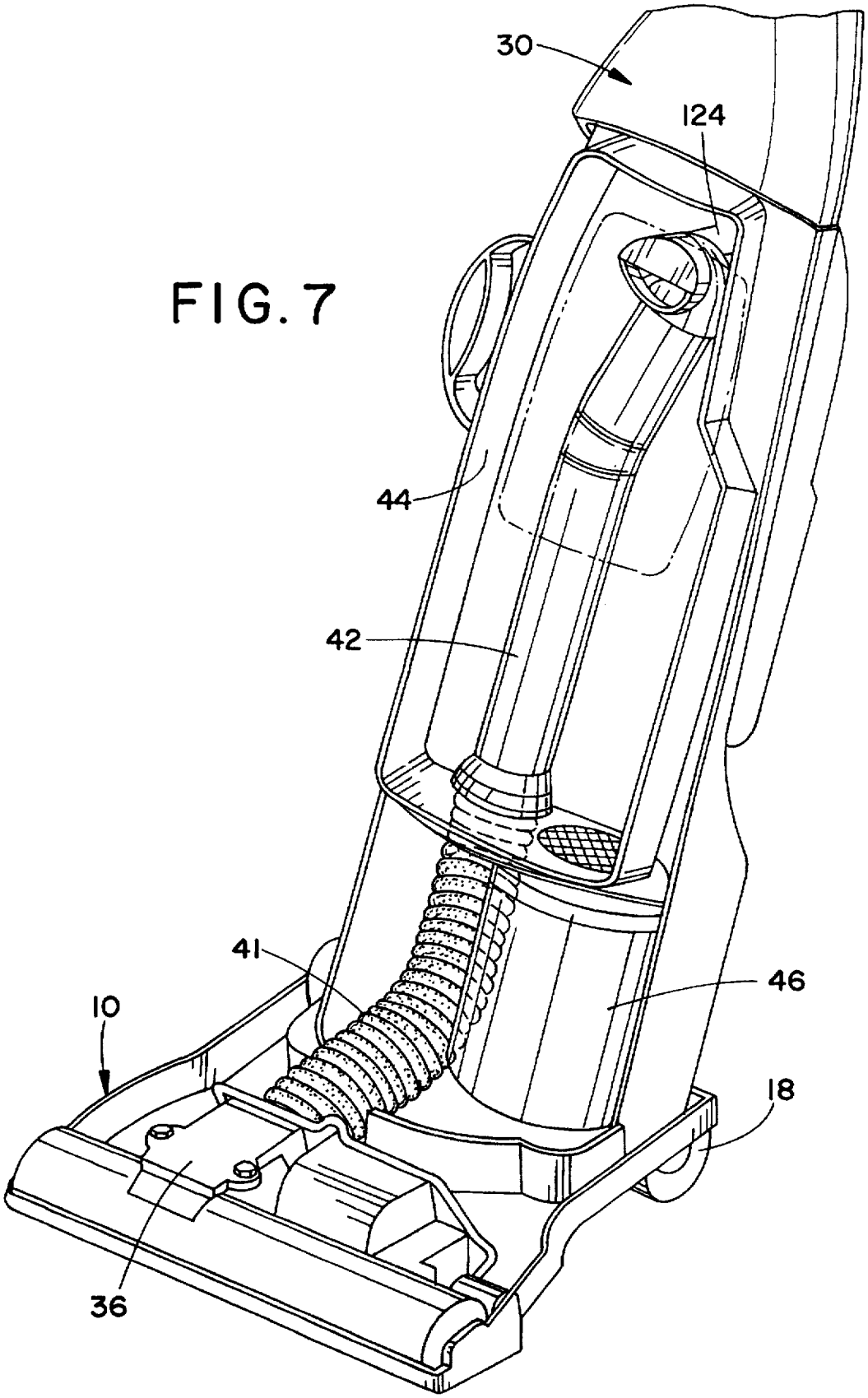

Rotatably mounted on the nozzle base 10 is a handle body 30. The handle body 30 includes a motor housing front wall 32. With reference now also to FIG. 4, defined in the nozzle base 10 is a first air passageway 34 that communicates with the suction inlet 12. The first air passageway 34 is defined between a passage cover 36 and a passage base 38—both of which are secured to the nozzle base 10 by conventional fasteners (not visible)—and a portion 39 of a lower wall 40 of the nozzle base itself. The first air passageway 34 communicates with a second air passageway 41 formed by a flexible hose that connects the first air passageway 34 to a third air passageway 42 formed by a rigid tubular member housed in the handle portion 30, as is evident from FIG. 7. The third air passageway 42 terminates in a dust chamber 44 defined in the handle body 30. Communicating with the dust chamber 44 is a motor and fan assembly 46.

Figure 2:
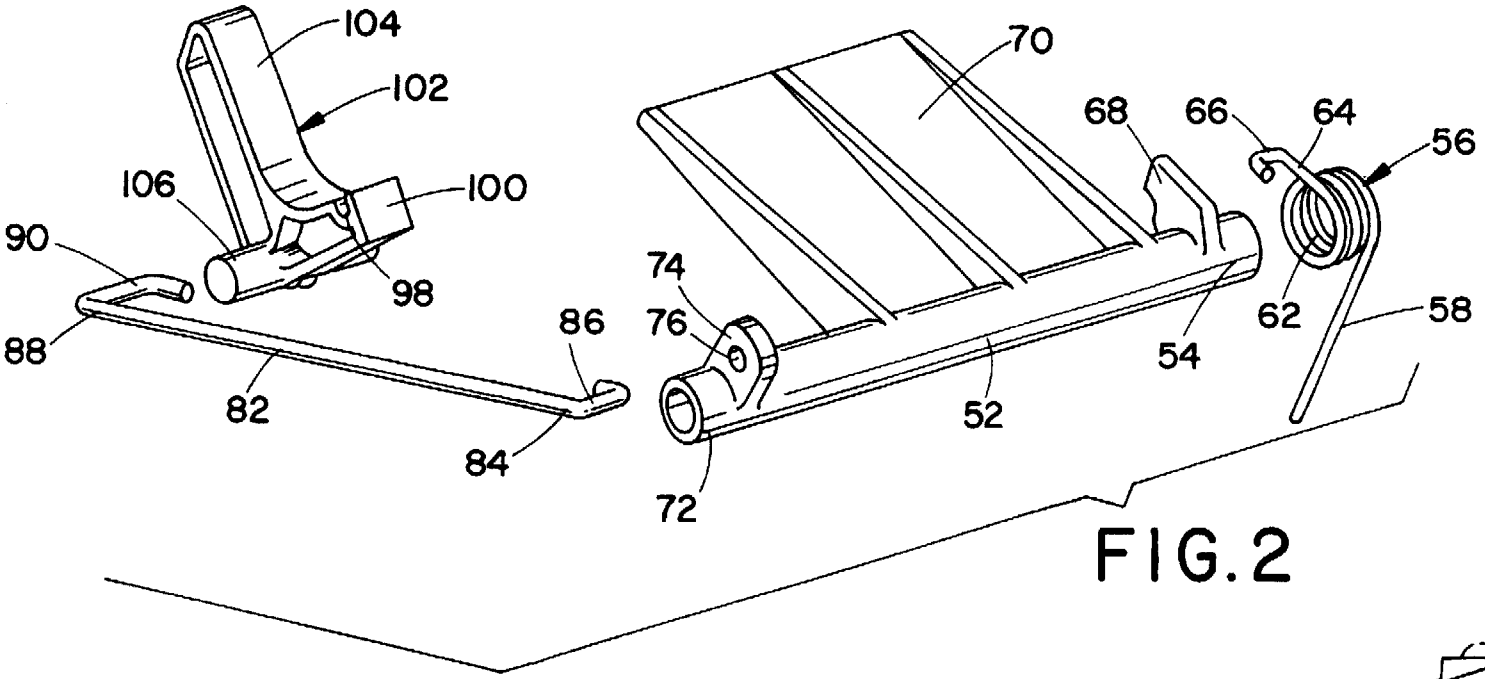
FIG. 2 is an enlarged exploded perspective view of a valve assembly including a linkage system according to the present invention.

With reference again to FIG. 1, a valve assembly 50 is pivotally mounted on the nozzle base 10 so that a portion of it is disposed in the first air passageway 34 defined between the cover 36 and the base 38 and the portion 39 of the nozzle base. With reference now also to FIG. 2, the valve assembly comprises a shaft 52 having a first end 54 on which a coil spring 56 can be mounted. The spring includes an elongated first end 58. The first end rests on an outer surface 60 of an upper wall 61 of the nozzle base 10, as shown in FIG. 1. The spring also includes a coiled central portion 62 which is so sized in diameter as to slidably fit on the shaft 52. A second end 64 of the spring terminates in a bent finger 66 which is accommodated in a recess of a first flange 68 located on the shaft 52 adjacent the first end 54 thereof. Projecting from the shaft 52 is a planar valve element 70. Located adjacent a second end 72 of the shaft 52 is a second flange 74. An aperture 76 extends through the second flange 74.

As illustrated in FIG. 1, a valve actuating means 80 cooperates with the shaft 52 to move the valve element 70. With reference again to FIG. 2, the valve actuating means 80 comprises a link member 82 having a first end 84 on which a bent first arm 86 is disposed. The first arm fits through the aperture 76 in the second flange 74 of the shaft 52. The link member 82 also includes a second end 88 on which a bent second arm 90 is located.

The second arm 90 is seated in a groove 98 defined in a first leg 100 of an L-shaped lever 102. The L-shaped lever also includes a second leg 104 and, at the intersection of the two legs 100, 104, a pivot shaft 106 around which the lever rotates. With reference now again to FIG. 5, the pivot shaft 106 of the L-shaped lever 102 is seated beneath a projecting bent finger 110 extending from the lower wall 40 of the nozzle base. The second leg 104 of the L-shaped lever 102 is accommodated in a groove 120 defined on the motor housing front wall 32 of the handle body. The groove 120 includes an upper end 122 which is abutted by a free end of the second leg 104 when the handle body 30 is pivoted to an upright orientation.

Figure 3:
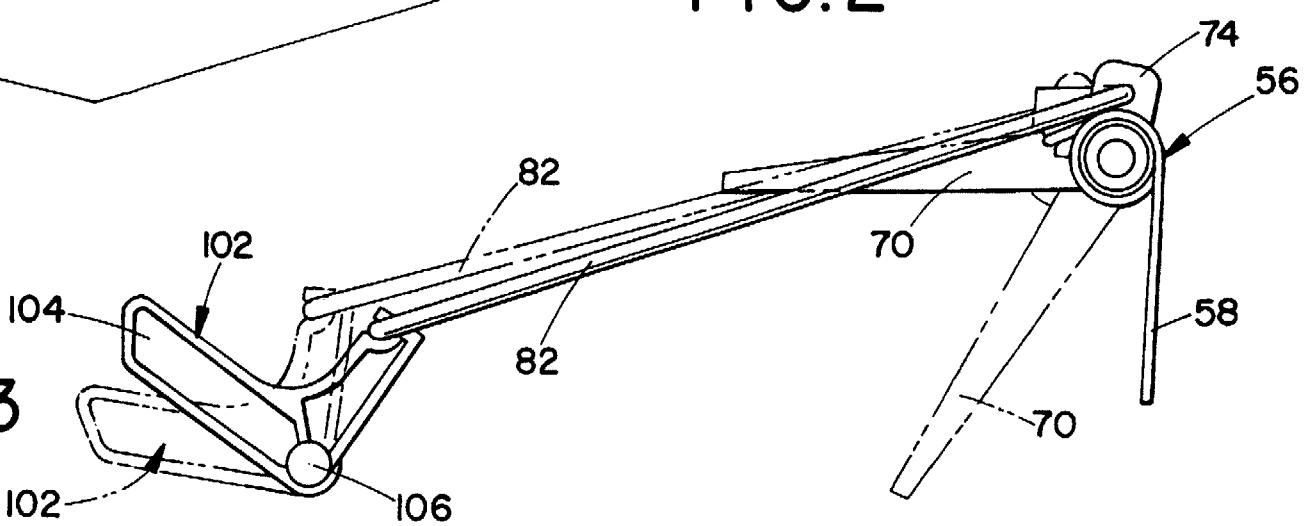
FIG. 3 is a side elevational view of the valve assembly and linkage system of FIG. 2 in an assembled condition illustrating the movement which takes place between the end positions of the linkage elements and the end positions of the valve element.

In order to actuate the valve 50 to block the first air passageway 34, the L-shaped lever 102 must be contacted by the groove upper end 122 of the handle body 30. This will take place when the handle body 30 is pivoted to an upright position in relation to the nozzle base 10. Movement of the end wall 122 of the groove 120 towards the subjacent floor surface will rotate the L-shaped lever 102 in a counterclockwise direction as is best illustrated in dotted outline in FIG. 3. Such counterclockwise rotation of the L-shaped lever 102 will cause a retraction of the link member 82 thereby pulling on the second flange 74. This will cause a counterclockwise rotation of the shaft 52 so as to move the valve element 70 in a counterclockwise manner from the solid outline position illustrated in FIG. 3 to the dotted outline position thereof. It can be seen from FIG. 4 that in the open position—as shown in solid outline in FIG. 3—the valve element allows a communication between the suction inlet 12 and the first air passageway 34. In the closed condition of the valve element, such communication is blocked. When flow is blocked through the first passageway 34, the suction motor 46 draws a suction through an auxiliary port 124 which is connected to the outlet of the third air passageway 42 as is evident from FIG. 7. The rotation of the shaft 52 is resisted by the spring 56. However, the spring resistance is overcome by the valve actuating means 80 when the handle assembly 30 is moved to the upright position.

When the handle 30 is again lowered—i.e., pivoted backwardly away from the perpendicular in relation to the nozzle base 10—the groove end wall 122 will no longer be in contact with the second leg 104 of the L-shaped lever 102. At this point, the spring 56 will urge the shaft 52 to rotate in a clockwise direction thereby raising the valve element 70 to its open position as illustrated in FIG. 4. When this happens, the link member 82 is translated forward as is most clearly seen from FIG. 3. At the same time, the L-shaped lever 102 is moved to an orientation in which its second leg 104 is located at an acute angle to the horizontal as is evident from FIGS. 3 and 5. It should be appreciated that the pivoting movement of the shaft 52 and the pivoting movement of the L-shaped lever 102 about its pivot shaft 106 are accomplished by the spring 56 since the spring acts on the shaft 52 and acts, via the link member 82, on the L-shaped lever 102.

It should be appreciated that the shaft 52 is pivotally mounted on the nozzle base upper wall 61 and is secured in place due to the fact that the cover 36 is fastened to the nozzle base 10. This traps the central portion of the shaft 52, including the valve element 70, in place.

Figure 6:
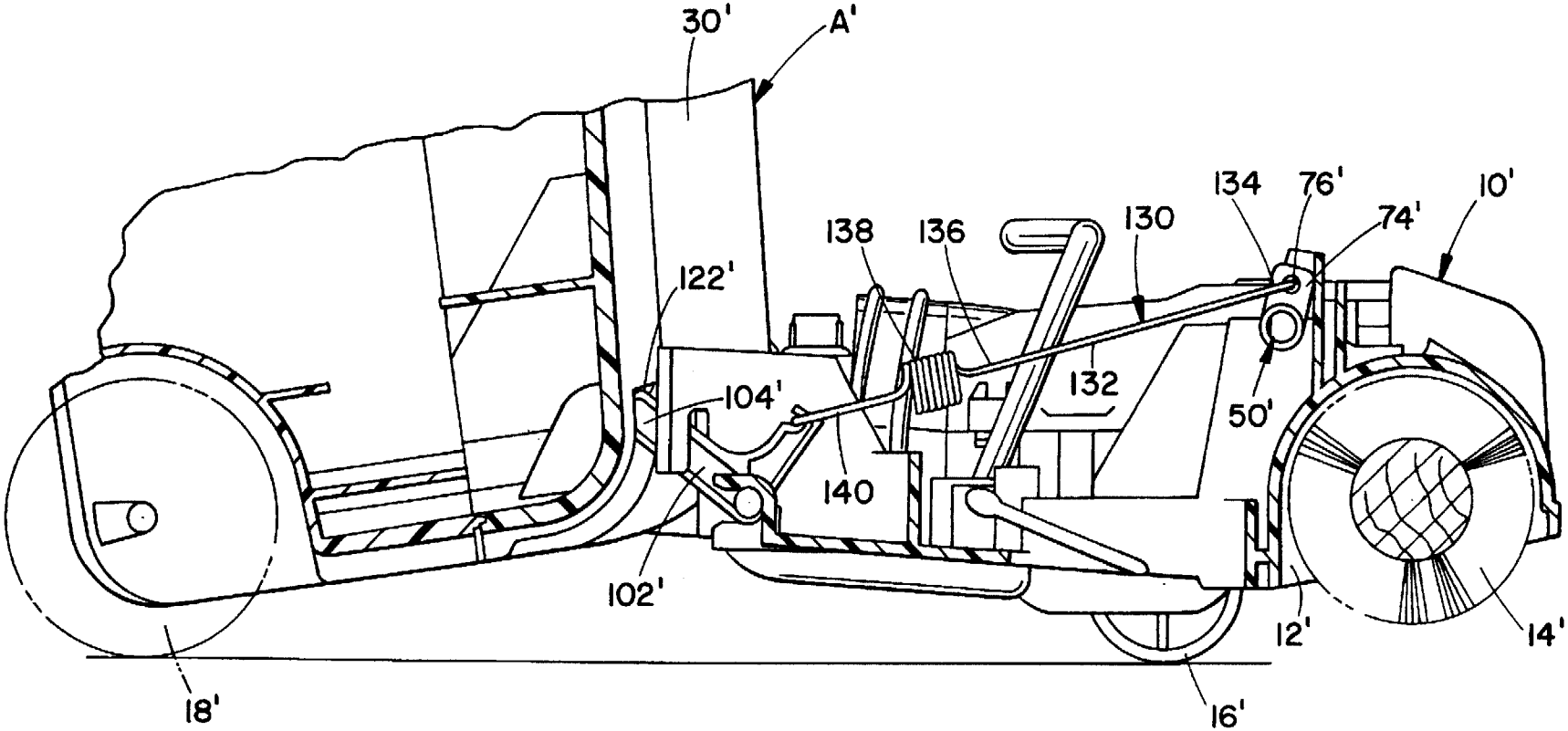
FIG. 6 is a side elevational view in cross-section of a vacuum cleaner employing a linkage system according to a second preferred embodiment of the present invention; and, FIG. 7 is a perspective view, partially broken away, of the nozzle base and handle portion of the vacuum cleaner of FIG. 1.

With reference now to FIG. 6, a second preferred embodiment of the invention is there illustrated. For ease of appreciation of this embodiment, like components are identified by like numerals with a primed (') suffix and new components are identified by new numerals.

In this embodiment, a suction cleaner A' includes a nozzle base 10' having a suction inlet 12' which defines a brush chamber. Mounted therein is a rotatable brush 14'. Supporting the nozzle base on a subjacent surface are a pair of first wheels 16' and a pair of second wheels 18' (only one of each of which is visible in FIG. 6). Pivotally mounted on the nozzle base 10' is a handle body 30'.

A valve 50' is pivotally mounted on the nozzle base 10'. The valve 50' includes a second flange member 74'. A valve actuating means 130 is supported on the nozzle base 10' for selectively moving the valve 50'. The valve actuating means comprises a link member 132 having a first end 134 which extends through an aperture 76' of the flange 74'. The link member 132 also includes a central portion 136 in which a coil tension spring 138 is defined. The link member also includes a second end 140 which cooperates with an L-shaped lever 102' pivotally mounted on the nozzle base 10'. It can be seen that the spring 138 is of one piece with the first and second ends 134 and 140 of the link member 132. For this purpose, the link member can be made from a suitable conventional wire type material.

The spring 138 serves as an overload spring for the valve actuating means 130. If an obstruction is encountered by the valve element of the valve member 50', the spring 138 comes into play. When the handle 30' is raised to the upright position and a groove end wall 122', contacts a second leg 104' of the L-shaped lever 102', thereby rotating the lever counterclockwise and pulling on the link member 132, this would normally pull on the second flange 74' and thus rotate the valve 50' in a counterclockwise direction. Therefore, the valve element would normally be urged to close the first air passageway defined in the nozzle base 10'. However, should a blockage be encountered in that passageway, the overload spring 138 will allow a continued rotation of the L-shaped lever 102', as urged by the handle body 30', without a corresponding continued rotation of the valve 50' since such rotation of a valve element of the valve is blocked by the obstruction which has been encountered. The continued rotation of the L-shaped lever 102' is accommodated by a stretching of the tension spring 138 of the link member 132. In addition, the overload spring is advantageous because it allows the valve actuating means 130 to compensate for any tolerance errors in the dimensions of the several components of the valve assembly.

The invention has been described with reference to preferred embodiments. Obviously, modification and alterations will occur to others upon a reading and understanding of this specification. It is intended to include all such modifications and alterations insofar as they come within the scope of the appended claims or the equivalents thereof.

What is claimed is:

1. A suction cleaner comprising:

a nozzle body including a suction inlet;

a handle pivotally connected to said body;

a suction creating means located in one of said handle and said body;

an air passageway leading from said suction inlet to said suction creating means;

a valve member located in said air passageway, wherein said valve member comprises:

a shaft pivotally mounted in said nozzle body, and a valve element fixedly mounted on said shaft;

a means for selectively pivoting said valve member in a first direction, said means for pivoting comprising:

a lever pivotally mounted on said nozzle body, and a link member having a first end secured to said lever and a second end secured to said shaft; and, a means for urging said valve member in a second direction, said means for urging comprising a biasing member mounted on one of said shaft and said nozzle body.

2. The cleaner of claim 1 wherein said lever comprises an L-shaped member having a first end, to which an end of said link member is secured, and a second end.

3. The cleaner of claim 2 wherein said second end of said L-shaped member cooperates with said handle.

4. The cleaner of claim 3 wherein said handle comprises a groove in which said second end of said L-shaped member is seated and a wall terminating said groove, wherein a rotation of said handle to an upright position will cause said lever to contact said wall terminating said groove so as to rotate said lever and cause said valve to close said air path.

5. The cleaner of claim 1 wherein said valve member further comprises a flange to which an end of said link member is secured.

6. The cleaner of claim 1 wherein said means for selectively pivoting further comprises a resilient spring connected to said link member.

7. The cleaner of claim 1 wherein said link member comprises:

a first section;

a spring member; and, a second section, wherein said spring member is of one piece with said first and second sections.

8. The cleaner of claim 1 wherein said biasing member comprises a spring.

9. A suction cleaner comprising:

a nozzle body including a suction inlet;

a handle pivotally mounted on said nozzle body and movable between a use position and a non-use position;

a suction creating means located in one of said handle and said body;

an air passageway leading from said suction inlet to said suction creating means;

a valve member located in said air passageway, wherein said valve member comprises:

a shaft pivotally mounted on said nozzle body, and a valve element fixedly mounted on said shaft; and, a means for selectively pivoting said valve member in a first direction, said means for pivoting comprising:

a lever pivotally mounted on said nozzle body, and a link member having a first end secured to said lever and a second end secured to said shaft, wherein said lever comprises a member having a first end, to which an end of said link member is secured, and a second end, wherein said second end of said member cooperates with said handle.

10. The cleaner of claim 9 further comprising a biasing member mounted on one of said shaft and said nozzle body for urging said valve element in a second direction.

11. The cleaner of claim 9 herein said handle comprises a groove in which said second end of said member is accommodated and a wall terminating said groove, wherein a rotation of said handle to an upright position will cause an end wall of said groove to contact and rotate said lever and cause said valve to close said air path.

12. The cleaner of claim 9 wherein said valve member further comprises a flange to which an end of said link member is secured.

13. The cleaner of claim 9 wherein said means for selectively pivoting further comprises a resilient spring opperatively connected with said link member.

14. The cleaner of claim 9 wherein said link member comprises:

a first section;

a spring member; and, a second section, wherein said spring member is of one piece with said first and second sections.

15. The cleaner of claim 9 further comprising a biasing member mounted on one of said shaft and said nozzle body for urging said valve member in a second direction.

16. A valve assembly for a suction cleaner, comprising:

an air passageway leading from a suction inlet of the suction cleaner to a filter chamber thereof;

a valve member located in said air passageway, wherein said valve member comprises:

a shaft pivotally mounted in a housing of the suction cleaner, a valve element fixedly mounted on said shaft;

a means for selectively pivoting said valve member in a first direction, said means for pivoting comprising:

a lever pivotally mounted in said housing in a spaced relationship to said shaft, and a link member having a first end secured to said lever and a second end secured to said shaft; and, a means for urging said valve member in a second direction, said means for urging comprising a biasing member mounted on one of said shaft and said housing.

17. The cleaner of claim 16 wherein said lever comprises an L-shaped member having a first end, to which an end of said link member is secured, and a second end, wherein said second end of said L-shaped member cooperates with a handle of said suction cleaner.

18. The cleaner of claim 16 wherein said valve member further comprises a flange to which said second end of said link member is secured.

19. The cleaner of claim 16 wherein said means for selectively pivoting further comprises a resilient spring operatively connected with said link member.

20. The cleaner of claim 16 wherein said link member comprises:

a first section;

a spring member; and, a second section, wherein said spring member is of one piece with said first and second sections.

21. The cleaner of claim 16 wherein said biasing member comprises a spring.

* * * * *